United States Patent [19]

Yokoyama

[11] Patent Number: 5,035,191

[45] Date of Patent: Jul. 30, 1991

[54] CLOTH HOLDER FOR AUTOMATIC SEWING MACHINE

[75] Inventor: Ryuiti Yokoyama, Toyonaka, Japan

[73] Assignee: Yamato Mishin Seizo Kabushiki Kaisha, Osaka, Japan

[21] Appl. No.: 443,199

[22] Filed: Nov. 30, 1989

[30] Foreign Application Priority Data

Nov. 30, 1988 [JP] Japan ..... 63-304569

[51] Int. Cl.[5] ..... D05B 3/12

[52] U.S. Cl. ..... 112/104; 112/113; 112/114; 112/121.15

[58] Field of Search ..... 112/104, 113, 114, 121.11, 112/306, 153, 265.1, 121.15

[56] References Cited

U.S. PATENT DOCUMENTS

| | | | |
|---|---|---|---|
| 4,711,188 | 12/1987 | Yoneda | 112/104 |
| 4,766,828 | 8/1988 | Nomura et al. | 112/153 X |
| 4,777,896 | 10/1988 | Nomura | 112/121.11 X |
| 4,909,167 | 3/1990 | Goldbeck et al. | 112/104 X |

*Primary Examiner*—Peter Nerbun

[57] ABSTRACT

A patterned cloth holding apparatus for an automatic sewing machine, which apparatus comprises a cloth holder for holding a generally rectangular piece of fabric at a position spaced from a position where the rectangular piece of fabric is to be sewed on a cloth having a patterned right face. The piece of fabric has a patterned right face, and respective patterns on the piece of fabric and the cloth are, when the piece of fabric is held by the cloth holder, oriented upwards. The apparatus also comprises first and second marking lamps for illuminating a point in an area comprising left and right and front and rear portions of the piece of fabric and a point in an area comprising left and right and front and rear portions of the cloth, respectively, so that the patterns on the respective right faces of the cloth and the piece of fabric can be aligned with each other, and a holder device for reversing the cloth holder to transport the piece of fabric towards the position where the piece of fabric is sewed on the cloth.

6 Claims, 6 Drawing Sheets

CLOTH HOLDER FOR AUTOMATIC SEWING MACHINE

BACKGROUND OF THE INVENTION

1. Field of the Invention

The present invention relates to a cloth holder for an automatic sewing machine of a type used to automatically sew a welt cloth or flap cloth on a cloth shell to complete a welt in a vest or breast pocket or a flap in each side pocket in a garment such as, for example, suits, or trousers. More specifically, the present invention relates to a cloth holder for the automatic sewing machine for holding the welt cloth or flap cloth during the sewing operation so that a pattern in the welt cloth or flap can be aesthetically aligned with a mating pattern in that portion of the cloth shell where the welt cloth or flap cloth is to be sewed.

2. Description of the Prior Art

As is well known to those skilled in the art, a suit has a pair of side pockets and a breast pocket on an outer surface thereof. The side pockets have generally rectangular flaps each overlaying the mouth leading to the interior of the respective side pocket, whereas the breast pocket has a welt reinforcing a peripheral lip defining the mouth of the breast pocket.

Where the suit has a certain pattern, for example, vertically extending stripes, a problem has hitherto been encountered in that a generally rectangular flap cloth which eventually forms the flap for each side pocket must be sewed on the suit cloth adjacent the corresponding side pocket with the stripes aligned with mating stripes on the right face of the flap cloth, and similarly, a generally rectangular welt cloth which eventually forms the welt for the breast pocket must be sewed on the suit cloth adjacent the breast pocket with the stripes aligned with the mating stripes on the right face of the welt cloth. Where the stripes on the suit cloth are out of alignment with those on the flap cloth or the welt cloth, the resultant suit lacks an aesthetically pleasing appearance. This is particularly true of the welt which is readily noticeable. If the flap cloth or the welt cloth is sewed on the suit cloth with the pattern on the flap cloth or welt cloth misaligned with those on the suit cloth, the resultant suit is generally regarded as having a low commercial value in the market.

According to the prior art, as a means for positioning the flap cloth or the welt cloth so as to overlap with the suit cloth which has been held at a predetermined position with the patterned right face thereof oriented upwards, a cloth holder is used to hold the flap cloth or the welt cloth with its patterned right face oriented upwards, which cloth holder is subsequently moved in a horizontal plane or a plane inclined relative to a vertical direction so that the flap cloth or the welt cloth can be overlapped with the suit cloth.

Apart from the use of the mechanical device such as the cloth holder referred to above, a manual procedure is also widely employed in which a sewing attendant worker holds the flap cloth or the welt cloth in hand and place it on the suit cloth with the pattern on the flap cloth or the welt cloth aligned with that on the suit cloth.

Whether the mechanical device is employed or the manual procedure is employed, the flap cloth or the welt cloth is placed on the patterned right face of the suit cloth with the pattern thereof oriented upwards and is then sewed thereon. Therefore, it has been felt difficult to accomplish a pattern alignment, i.e., an alignment of the pattern on the flap cloth or the welt cloth with the corresponding pattern on the suit cloth. In addition, it has been found that, when the flap or welt is reversed so that the pattern on the flap or welt can appear outside of the suit, the pattern on the flap or welt is often found misaligned with the pattern on the suit, causing the resultant suit to lack an aesthetically pleasing appearance, accompanied by a reduction in commercial value thereof in the market.

SUMMARY OF THE INVENTION

The present invention has been devised with a view to substantially eliminating the above discussed problems and is intended to provide an improved patterned cloth holding apparatus for an automatic sewing machine which is effective to accurately and quickly accomplish a pattern alignment between a patterned piece of fabric and a correspondingly patterned cloth on which the piece of fabric is to be sewed.

In order to accomplish the above described object, the present invention provides a patterned cloth holding apparatus for an automatic sewing machine, which apparatus comprises a cloth holder for holding a generally rectangular piece of fabric at a position spaced from a position where the rectangular piece of fabric is to be sewed on a cloth having a patterned right face. The piece of fabric has a patterned right face, and respective patterns on the piece of fabric and the cloth are, when the piece of fabric is held by the cloth holder, oriented upwards. The apparatus also comprises first and second marking lamp means for illuminating a point in an area comprising left and right and front and rear portions of the piece of fabric and an area comprising left and right and front and rear portions of the cloth, respectively, so that the patterns on the respective right faces of the cloth and the piece of fabric can be aligned with each other, and a holder device for reversing the cloth holder to transport the piece of fabric toward the position where the piece of fabric is sewed on the cloth.

According to another preferred embodiment of the present invention, the cloth holder comprises a fixed clamp table extending in a direction generally parallel to the longitudinal sense, or direction of sewing, of the generally rectangular piece of fabric and a movable clamp plate mounted on a shaft for rotation together therewith and arranged so as to confront the fixed clamp table, said movable clamp plate being rotatable together with the shaft between a first position, in which the piece of fabric can be held between the fixed clamp table and the movable clamp plate, and a second position in which the piece of fabric is released from both of the fixed clamp table and the movable clamp plate, the movable clamp plate having a plurality of equally spaced slits defined therein so as to leave an elastically and independently displaceable clamp pawl between each of the neighboring slits.

The generally rectangular piece of fabric to be sewed on the cloth may be either a flap cloth which eventually forms a flap for a side pocket on a suit, or a welt cloth which eventually forms a welt for a breast pocket on the suit.

According to the present invention, at a position spaced from the position where the flap cloth or welt cloth is to be sewed on the suit cloth which has been set in position with the patterned right face oriented upwards, the flap cloth or the welt cloth is held by the cloth holder with its patterned right face oriented upwards. While in this condition, the marking lamps are used to illuminate a point on the patterned right face of the suit cloth and a point on the patterned right face of the flap cloth or the welt cloth, respectively, so as to facilitate the pattern alignment between the suit cloth and the flap cloth or the welt cloth. After the pattern alignment, the cloth holder is reversed to move the flap cloth or the welt cloth held by the cloth holder to the position above the suit cloth where it is to be sewed on the suit cloth and, consequently, the flap cloth or the welt cloth can be overlapped with the suit cloth with the pattern on the flap cloth or the welt cloth aligned with that on the suit cloth.

Thus, the pattern alignment between the flap cloth or the welt cloth and the suit cloth can readily and quickly be accomplished with the respective patterned right faces of the flap cloth or the welt cloth and the suit cloth oriented upwards, and by the reversal of the cloth holder which is effected subsequent to the pattern alignment, the flap cloth or the welt cloth in a predetermined sewing position, that is, with its patterned right face oriented upwards, can be overlapped with the suit cloth. Therefore, misalignment between the pattern on the suit cloth and that on the flap cloth or welt cloth can be advantageously avoided.

Furthermore, according to the present invention, the cloth holder comprises the fixed clamp table and the movable clamp plate having a plurality of elastically and independently displaceable clamp pawls with a pawl interposed between each of the neighboring slits defined in the movable clamp plate. Therefore, even though the flap cloth or the welt cloth has a varying thickness in a direction conforming to the lengthwise direction thereof, the clamp pawls can elastically yield to accommodate the varying thickness of the flap cloth or the welt cloth so that the flap cloth or the welt cloth can be sandwiched under uniform pressure over the length thereof. Accordingly, the flap cloth or the welt cloth can be steadily held by the cloth holder and, even during the transportation thereof subsequent to the pattern alignment, no arbitrary displacement of the flap cloth or the welt cloth occurs which would otherwise result in the misalignment of the pattern between the flap cloth or the welt cloth and the suit cloth.

DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined solely by the appended claims. In the accompanying drawings, like reference numerals are used to denote like parts throughout the several views, and:

DETAILED DESCRIPTION OF THE EMBODIMENTS

Figure 1:
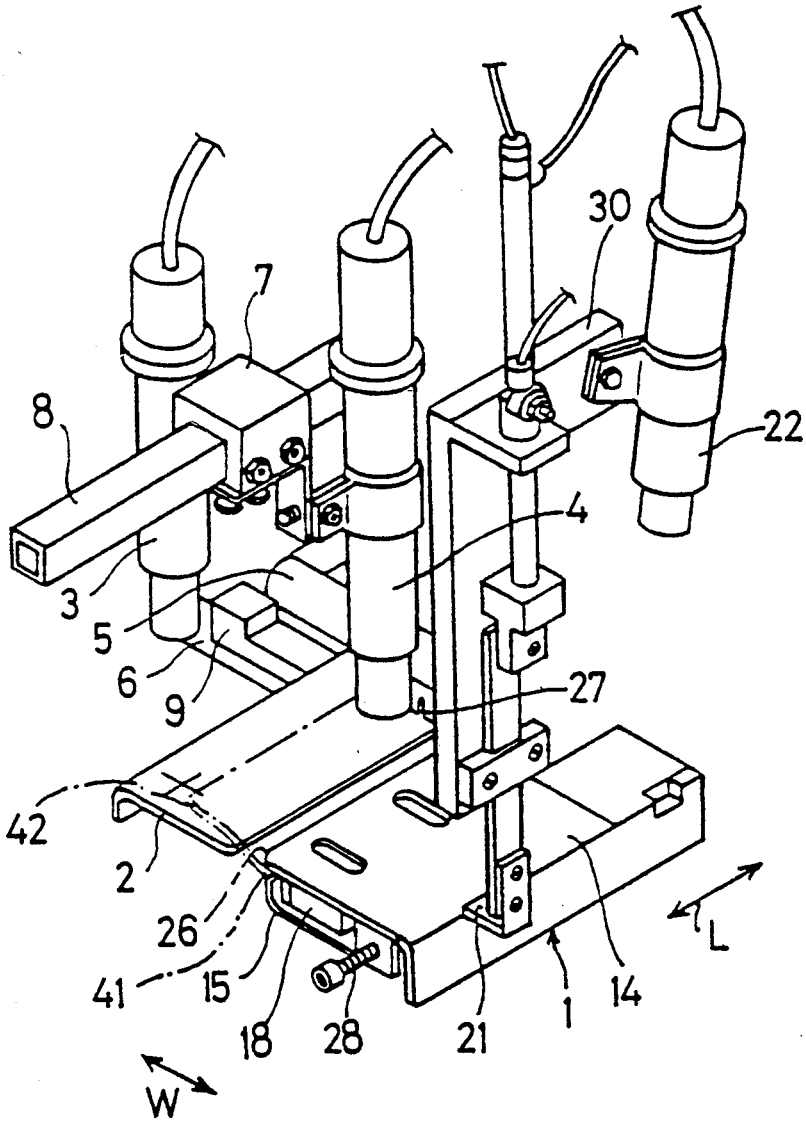
FIGS. 1 and 2 are fragmentary perspective views of a portion of a cloth holder according to one preferred embodiment of the present invention in different operative positions, respectively.

Hereinafter, one preferred embodiment of the present invention will be described with reference to the accompanying drawings. It is to be noted that the cloth holder designed for the automatic sewing machine according to the present invention can be utilizable not only for the support of a generally rectangular flap cloth for the formation of the flap for each side pocket, but also for the support of a welt cloth for the formation of the welt in the breast pocket, reference will be made to the support of the flap cloth in the following description of the preferred embodiment of the present invention.

Referring to FIGS. 1 to 4, a cloth holding device according to the present invention comprises a holder generally identified by 1 and a base plate 2. The cloth holder 1 shown therein is used to hold a generally rectangular flap cloth 26, which eventually forms a flap for each side pocket, on an automatic sewing machine so that a pattern in the flap cloth can be aesthetically aligned with a mating pattern in a portion of a suit cloth 25 (FIG. 6) immediately above the corresponding side pocket. More specifically, as best shown in FIG. 7, the generally rectangular flap cloth 26 is, prior to being placed on the automatic sewing machine through the suit cloth, folded along a line parallel to the longitudinal sense of the flap cloth to provide first and second flap cloth areas 26A and 26B, the first flap cloth area 26A having a width greater than that of the second flap cloth area 26B and being continued to the second flap cloth area 26B through a folded edge 41. The cloth holder 1 is used to hold the folded edge 41 against the suit cloth 25 with the patterned right face thereof oriented upwards while a pattern on the right face of the first flap cloth area 26A 16A is aligned with a mating pattern in that portion of the suit cloth 25 having its right face oriented upwards. On the other hand, the base plate 2 is used for the support thereon of a free edge 42 of the first flap cloth area 26A of the flap cloth 26 opposite to the folded edge 41.

Figure 2:
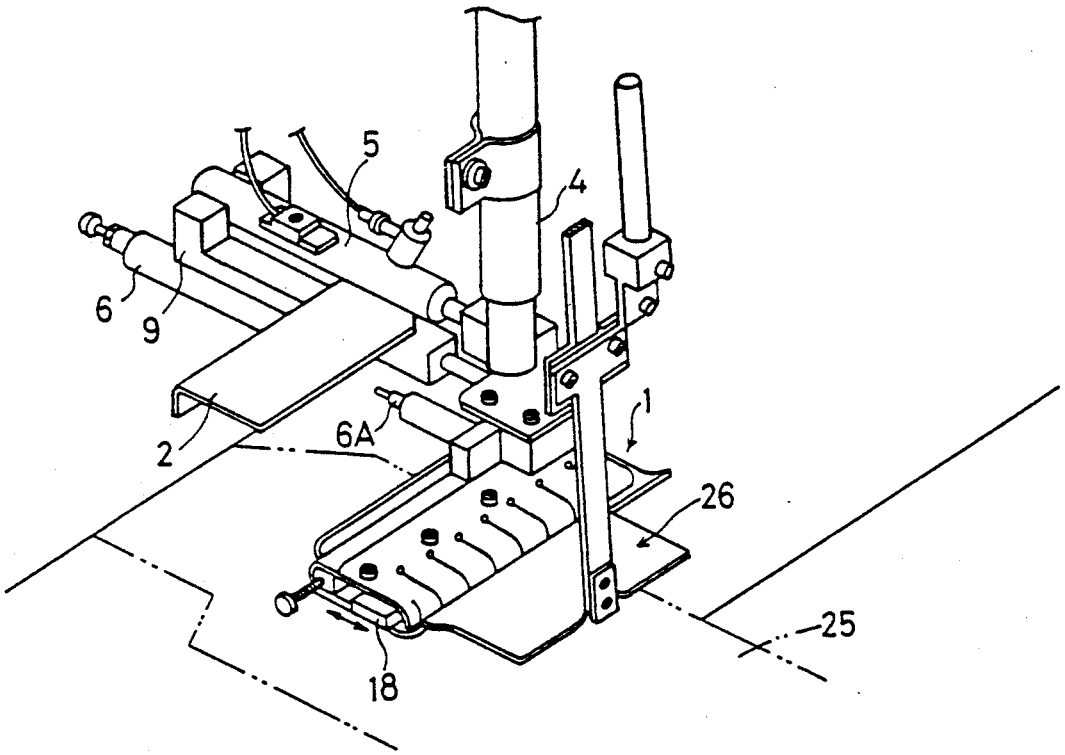
Figure 3:
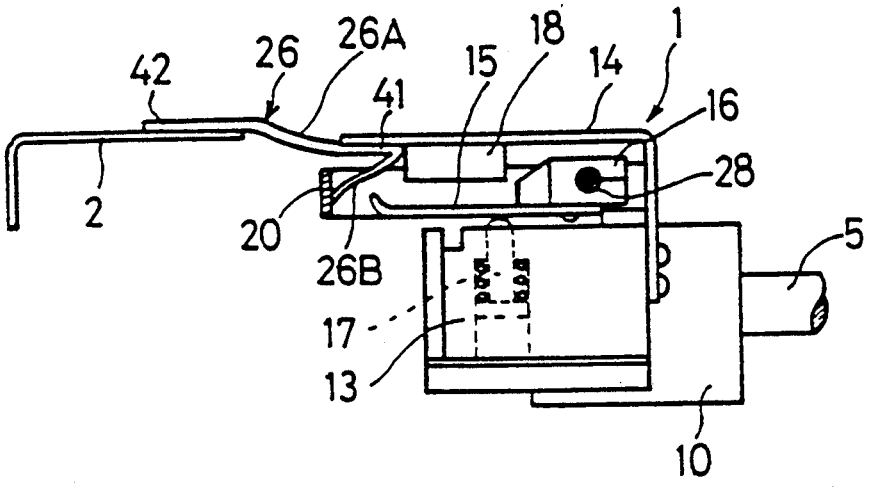
FIGS. 3 and 4 are side views of that portion of the holder shown in FIGS. 1 and 2, respectively.
Figure 4:
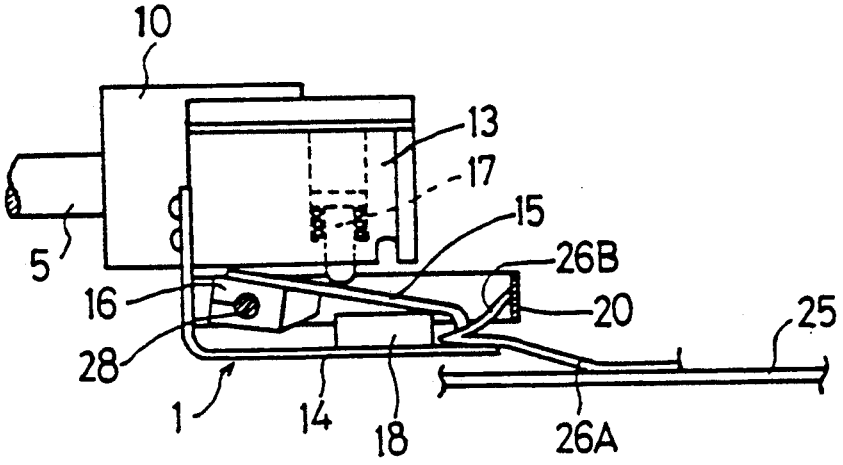
Figure 5:
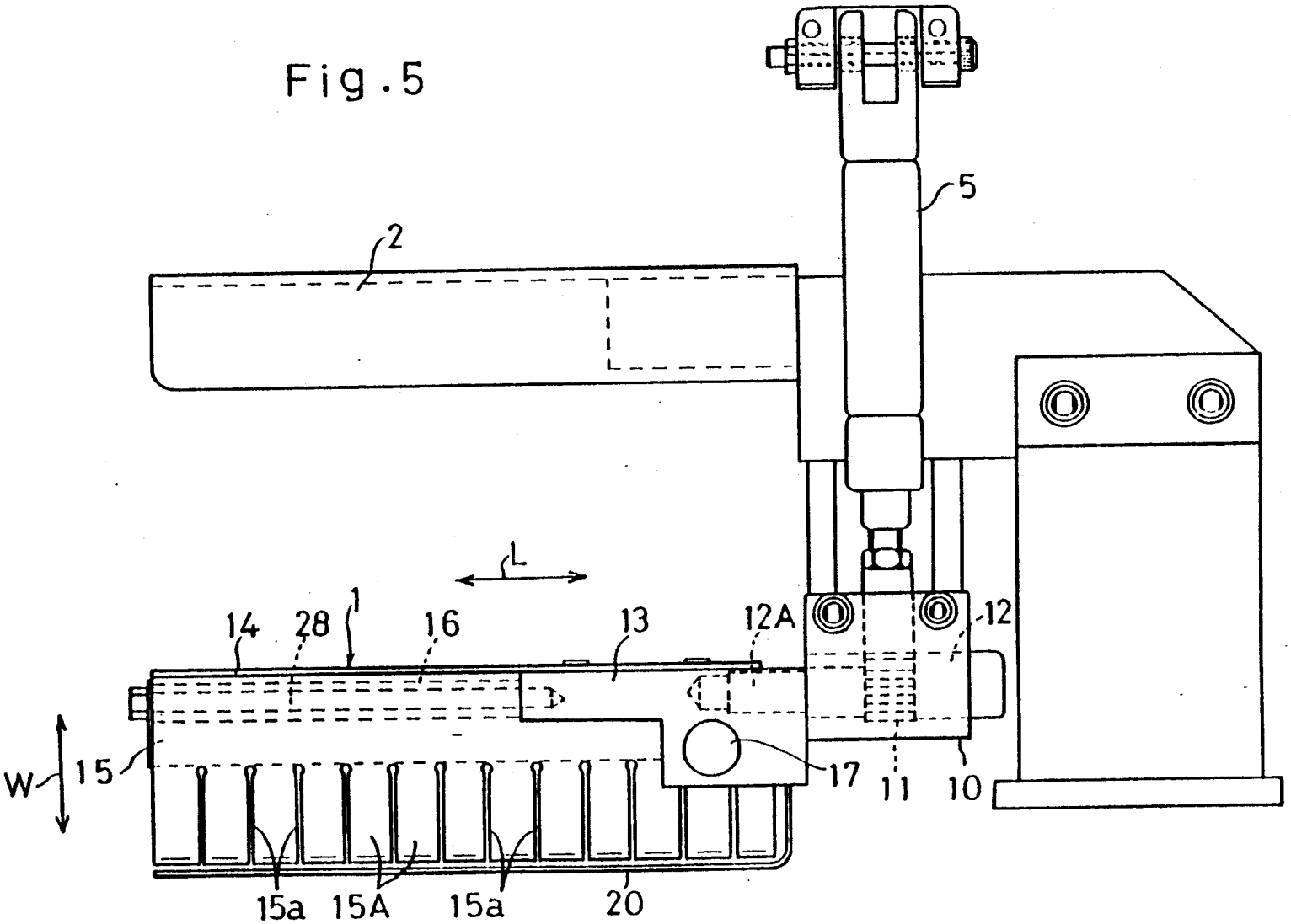
FIGS. 5 and 6 are elevational and side views, on an enlarged scale, of the holder according to the present invention.

Reference numeral 5 represents a first drive cylinder fitted to a cylinder mount 9 and having a plunger formed with a rack gear 11 as shown in FIG. 5. The rack gear 11 is housed with a gear box 10 together with a pinion gear 12 rotatably supported therein and meshed with the rack gear 11. Reference numeral 13 represents a turntable to which the cloth holder 1 is secured and with which one end of a rotary shaft 12A having the pinion gear 12 mounted thereon for rotation together therewith is coupled. The first drive cylinder 5, the rack gear 11, the pinion gear 12 and the turntable 13 together constitute a reversing mechanism for reversing the cloth holder 1. This reversing mechanism is so designed and so operated that, when the plunger of the drive cylinder is moved to an extended position, the movement of the plunger of the drive cylinder is transmitted to the turntable 13 through the rack gear 11 and the pinion gear 12 meshed with the rack gear 11 to rotate the cloth holder 1 through 180° about the rotary shaft 12A so that the cloth holder 1 once held in a first operative position shown in FIGS. 1 and 3 can assume a second or inverted position as shown in FIGS. 2 and 4.

Reference numeral 6 represents a second drive cylinder having a piston rod 6A connected at a free end thereof fixedly with the gear box 10 (FIG. 5). The piston rod 6A of the second drive cylinder 6 is movable between retracted and extended positions for causing the holder 1 to move to one of an overlapping position, at which the flap cloth 26 can be overlapped with the suit cloth 25, and a stand-by position spaced a distance from the overlapping position. A composite movement accomplished by a combination of the second drive cylinder 6 and the reversing mechanism including the previously discussed first drive cylinder 5 constitutes a holder drive device operable to reverse the holder 1 and to move the flap cloth 26 from the stand-by position towards the overlapping position.

Reference numeral 3 represents a first marking lamp for projecting a light beam on a point on the patterned right face of the flap cloth 26. Reference numeral 4 represents a second marking lamp for projecting a light beam on a point on the patterned right face of the suit cloth 25. Both of the first and second marking lamps 3 and 4 are supported by a common lamp support 7 which is slidably mounted on a guide arm 8 protruding laterally from the automatic sewing machine (not shown) so that the respective positions of the light beams from the first and second marking lamps 3 and 4 can be adjusted with respect to the right and left directions as well as the front and rear directions, while the relative position between the first and second marking lamps 3 and 4 can be kept constant at all times.

Reference numeral 18 represents a magnet strip which is, when the flap cloth 26 is to be held by the holder 1, engaged with one end of the flap cloth 26 with respect to the widthwise direction W thereof to position the flap cloth 26 in a direction parallel to the widthwise direction W. Reference numeral 27 represents a pin secured to the base plate 2 so as to protrude upwards therefrom and engageable with one end of the rectangular flap cloth 26 with respect to the lengthwise direction L thereof for positioning the flap cloth 26 in a direction parallel to the lengthwise direction L thereof when the flap cloth 26 is to be held by the holder 1. Reference numeral 20 shown in FIGS. 3 and 4 represents a separator piece engageable with a free edge of the second flap cloth area 26B of the flap cloth 26 to separate the second flap cloth area 26B away from the first flap cloth area 26A. Reference numeral 30 shown in FIG. 1 represents a connecting piece used to permit the entire structure of the cloth holding device to be supported by a machine arm of the automatic sewing machine.

Reference numeral 21 represents a reflecting tape for a photoelectric tube operable in such a manner that, by detecting one end of the flap cloth 26 in a direction parallel to the lengthwise direction thereof by the use of a photoelectric tube (not shown), the entire length of the flap cloth 26 can be measured to provide a data descriptive of the entire length of the flap cloth 26, which data is inputted to an operation control unit of the automatic sewing machine.

Reference numeral 22 represents a third marking lamp for detecting the arrival of one of the opposite ends of the flap cloth 26 from which stitching is to be initiated and for generating a start signal to the operation control unit of the sewing machine. Reference numeral 24 shown in FIG. 6 represents a presser for retaining the suit cloth 25.

The details of the cloth holder 1 will now be described with particular reference to FIGS. 5 and 6.

Figure 6:
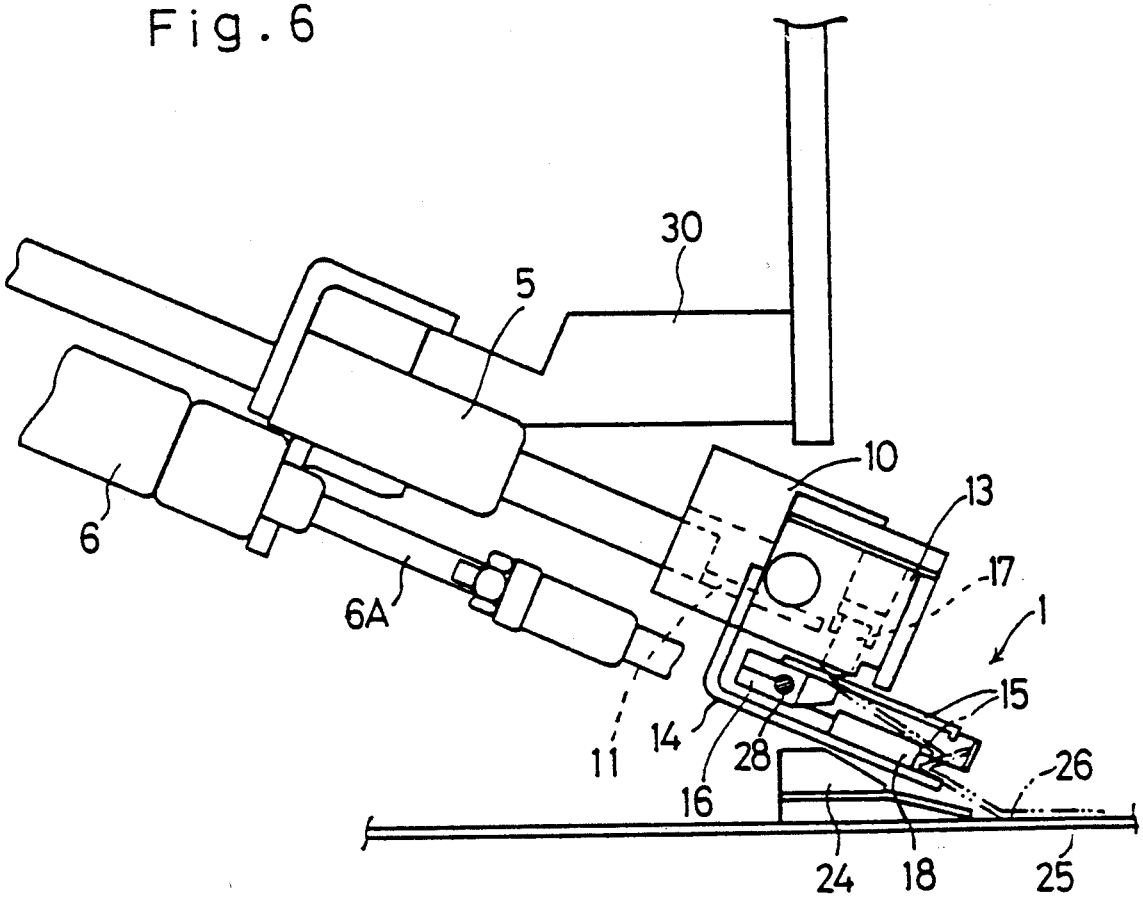
Figure 7:
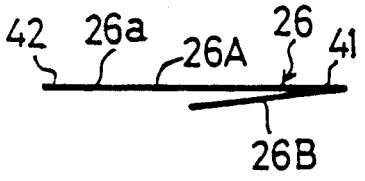
FIG. 7 is a schematic sectional view of a pocket welt or a flap.

Referring now to FIGS. 5 and 6, reference numeral 14 represents a generally rectangular fixed clamp table fixed to the turntable 13 so that opposite longer side edges of the fixed clamp table 14 can extend in a direction generally parallel to the longitudinal sense of the rectangular flap cloth 26. The magnet strip 18 referred to hereinabove is magnetically attracted to an inner surface of the fixed clamp table 14 for adjustment in position in a direction parallel to the widthwise direction W. Reference numeral 15 represents a movable clamp plate arranged so as to confront the fixed clamp table 14 and is mounted on the fixed clamp table 14 through a screw shaft 28 extending through a base 16 therefor, so that the movable clamp table 14 can be moved incident to the rotation of the screw shaft 28 between a sandwiching position, in which the rectangular flap cloth 26 can be sandwiched between the fixed clamp table 14 and the movable clamp plate 15, and a released position in which the rectangular flap cloth 26 can be released from the fixed clamp table 14 and the movable clamp plate 15. Reference numeral 17 represents a drive cylinder for the movable clamp table, which cylinder 17 is mounted inside the turntable 13 for driving the movable clamp plate 15 about the screw shaft 28.

One side portion of the movable clamp plate 15 opposite to the base 16 is formed with a plurality of parallel slits 15*a* spaced an equal distance from each other in a direction parallel to the lengthwise direction L while leaving an elastically and independently displaceable clamp pawl 15A defined between each of the neighboring slits 15*a* in the movable clamp plate 15. These clamp pawls 15A are capable of elastic displacement independently of each other to accommodate a change in thickness of the flap cloth 26 in a direction parallel to the lengthwise direction L when the flap cloth 26 is held between the fixed clamp table 14 and the movable clamp plate 15, thereby holding respective portions of the flap cloth 26 under uniform pressure all over the length of the flap cloth 26. Accordingly, even though the flap cloth 26 may have a varying thickness over the length thereof, the flap cloth 26 can be steadily held by the cloth holder 1, thereby preventing any possible unexpected displacement of the flap cloth 26 during the reversal of the flap cloth 26 subsequent to a pattern aligning operation.

Hereinafter, the operation of the cloth holding device of the above described construction will be described.

Assuming that the cloth holder 1 is held in the stand-by position as shown in FIGS. 1 and 3, the flap cloth 26 folded to have the first and second flap cloth areas 26A and 26B positioned one above the other is manually set in position on the cloth holder 1 with the first flap cloth area 26A inserted in between the fixed clamp table 14 and the movable clamp plate 15 and also with the free edge 42 of the flap cloth 26 placed on the base plate 2 as shown in FIG. 3. At this time, as shown in FIG. 1, one end of the flap cloth 26 with respect to the lengthwise direction L thereof is brought into contact with the positioning pin 27 while one edge thereof with respect to the widthwise direction W thereof is brought into contact with a side edge of the magnet strip 18, thereby accomplishing a positioning of the flap cloth 26 in two-dimensional planes. Subsequently, the common lamp support 7 is to be manually moved so that, by the aid of the first marking lamp 3, a point of, for example, a striped pattern of the right face of the flap cloth 26 can be positioned in alignment with the first marking lamp 3. Thereafter, a pedal for sandwiching the flap cloth is depressed to actuate the drive cylinder 17 (FIG. 3) to cause one side edge of the first flap cloth area 26A of the flap cloth 26 to be sandwiched between the fixed clamp table 14 and the movable clamp plate 15.

Then, the suit cloth 25 is adjusted in position so that a mating stripe pattern on a portion of the right face of the suit cloth where a side pocket is defined can be aligned with the point on which the marking light beam emitted from the second marking lamp 4 is projected. Thereafter, a pedal (not shown) is depressed to lower the reflecting tape 21 for the photoelectric tube down to a predetermined position and, at the same time, to cause a suit cloth presser 24 (FIG. 6) to press the suit cloth 25 to fix the latter. By these procedures, the stripe pattern on the flat cloth 26 can be aligned with the mating stripe pattern on the suit cloth 25.

After the pattern alignment so effected in the manner as hereinabove described, a pocket defining textile bag is placed at a portion of the suit cloth 25 on which the textile bag is to be sewed and is fixed in position by the application of a pressure through a clamper (not shown). When a loading switch pedal (not shown) is then depressed, the first and second drive cylinders 5 and 6 are actuated to cause their respective plungers to move to the extended positions simultaneously and, by the effect of the composite motions of these plungers of the first and second drive cylinders 5 and 6, the cloth holder 1 as a whole can be rotated clockwise to bring the flap cloth 26 to a position on the suit cloth 25 where the flap cloth 26 should be overlapped, thereby assuming such a position as shown in FIGS. 2 and 4. Subsequently, a cloth retainer (not shown) is lowered to press the flap cloth 26, the pocket defining textile bag and the suit cloth 25 together in overlapping relationship, followed by switching of the cloth holder 1 over to the released position. Thereafter, consequent upon the retraction of the respective plungers of the first and second drive cylinders 5 and 6 from the extended position back to the retracted position, the cloth holder 1 as a whole is rotated counterclockwise to return to the initially assumed stand-by position.

Figure 8:
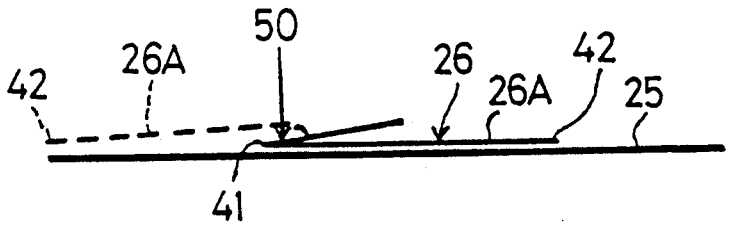
FIG. 8 is a schematic sectional view of the pocket welt or the flap which has been reversed from the condition of FIG. 7.

On the other hand, as shown in FIG. 8, the cloths then pressed by the cloth retainer with a reverse face of the first flap cloth area 26A of the flap cloth 26 oriented upwards are transported by a carriage (not shown) towards a stitching position in the automatic sewing machine and an intended stitching is then performed thereto from a reverse side of the side edge 41 of the first flap cloth area 26A in a direction shown by the arrow 50.

It is to be noted that, in the case of the flap cloth 26 referred to above in connection with the preferred embodiment of the present invention, during the stitching being performed, the first flap cloth area 26A is reversed, as shown by the phantom line, to render the patterned right face thereof oriented. However, in the case of the welt cloth, the opposite side edge 42 is also stitched to the suit cloth 25 while the first welt cloth area is reversed in a manner similar to the first flap cloth area 26A of the flap cloth 26.

As hereinbefore described, the accurate pattern alignment between the suit cloth and the flap cloth or the welt cloth can be readily and quickly accomplished by setting the flap cloth or the welt cloth with the patterned right face oriented upwards while the pattern on the right face thereof is aligned with the mating pattern on the right face of the suit cloth with the aid of the marking lamps 3 an 4.

Thus, according to the present invention, the pattern alignment between the suit cloth and the flap cloth or welt cloth can be readily and quickly accomplished through a simple procedure and, moreover, since no displacement between the flap cloth or welt cloth and the suit cloth will occur during and subsequent to the pattern alignment, the present invention is effective to permit even a less experienced worker to sew the flap cloth or welt cloth on the suit cloth efficiently to complete a pocket of an aesthetically pleasing appearance.

Furthermore, according to the present invention, even though the flap cloth or welt cloth has a varying thickness over the length thereof, the flap cloth or welt cloth of varying thickness can be steadily held by the cloth holder in relation to the sewing machine with no displacement occurring between the flap cloth or welt cloth and the suit cloth during the reversal thereof which takes place subsequent to the pattern alignment.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. For example, although in describing the preferred embodiment of the present invention, reference has been made to the generally rectangular flap cloth being sewed on the suit cloth in the vicinity of one of the side pockets, the foregoing description made in connection with the flap cloth can be equally applicable to the welt cloth.

Accordingly, such changes and modifications are, unless they depart from the spirit and scope of the present invention as delivered from the claims annexed hereto, to be construed as included therein.

What is claimed is:

1. A patterned cloth holding apparatus for an automatic sewing machine, which apparatus comprises:

a cloth holder for holding a generally rectangular piece of fabric at a first location spaced from a second location where said piece of fabric is to be sewed on a cloth having a patterned right face, said piece of fabric having a patterned right face, respective patterns on said piece of fabric and said cloth being, when said piece of fabric is held by said cloth holder, oriented upwards;

first and second marking lamp means for illuminating a point in an area comprising left and right and front and rear portions of said piece of fabric and a point in an area comprising left and right and front and rear portions of said cloth, respectively, so that the patterns on the respective right faces of said cloth and said piece of fabric can be aligned with each other; and a holder device for rotating said cloth holder about an axis of rotation to transport said piece of fabric toward said second position where said piece of fabric is sewed on said cloth.

2. The patterned cloth holding apparatus as claimed in claim 1, wherein said cloth holder includes a fixed clamp table extending in a direction generally parallel to the longitudinal sense of said piece of fabric and a movable clamp plate, said movable clamp plate being mounted on a shaft for rotation together with said fixed clamp table and being arranged so as to confront said fixed clamp table, said movable clamp plate being rotatable together with said shaft between a first position, in which said piece of fabric can be held between said fixed clamp table and said movable clamp plate, and a second position in which said piece of fabric is released from both of said fixed clamp table and said movable clamp plate, said movable clamp plate having a plurality of equally spaced slits defined therein with an elastically and independently displaceable clamp pawl between each pair of neighboring slits.

3. The patterned cloth holding apparatus as claimed in claim 1, wherein said piece of fabric is a flap cloth for a side pocket on a suit.

4. The patterned cloth holding apparatus as claimed in claim 1, wherein said piece of fabric is a welt cloth for a breast pocket on a suit.

5. The patterned cloth holding apparatus as claimed in claim 2, wherein said piece of fabric is a flap cloth for a side pocket on a suit.

6. The patterned cloth holding apparatus as claimed in claim 2, wherein said piece of fabric is a welt cloth for a breast pocket on a suit.

* * * * *